US005299967A

United States Patent [19]

Gilbert

[11] Patent Number: 5,299,967

[45] Date of Patent: Apr. 5, 1994

[54] MOVABLE FIGURE

[76] Inventor: John M. Gilbert, 4797 Highway, West Vancouver, British Columbia, Canada, V7W 1J6

[21] Appl. No.: 976,852

[22] Filed: Nov. 16, 1992

[51] Int. Cl.[5] ..... A63H 7/02; A63H 3/00

[52] U.S. Cl. ..... 446/288; 446/336; 446/362; 446/366; 273/87.4

[58] Field of Search ..... 446/336, 333-335, 446/362, 361, 359, 288, 365, 366; 273/87.4, 87.2, 129 V, 129 W; 294/19.1

[56] References Cited

U.S. PATENT DOCUMENTS

| | | | |
|---|---|---|---|
| 511,142 | 4/1885 | Pote | 273/87.4 |
| 731,825 | 6/1903 | Voorhees . | |
| 1,409,612 | 3/1922 | Stout | 273/87.4 |
| 1,539,251 | 5/1925 | Findlay . | |
| 1,657,388 | 1/1928 | Gorman | 273/87.4 |
| 1,926,980 | 9/1933 | Gorman | 273/129 |
| 2,222,499 | 4/1943 | Deaton | 46/126 |
| 2,327,234 | 8/1943 | Wolff et al. . | |
| 2,513,198 | 6/1950 | Munro | 273/129 |
| 2,616,700 | 11/1952 | Munro | 273/129 |
| 2,638,348 | 5/1953 | Arenson et al. | 273/87 |
| 2,785,899 | 3/1957 | Burke | 273/87.2 |
| 3,050,307 | 8/1962 | Glass et al. | 273/87.4 |
| 3,390,481 | 7/1968 | Runanin . | |
| 3,503,613 | 3/1970 | Caya | 273/87.4 |
| 3,598,411 | 8/1971 | Lippert | 273/129 |
| 4,040,206 | 8/1977 | Kimura . | |
| 4,091,563 | 5/1978 | Noble et al. | 46/334 |
| 4,186,518 | 2/1980 | Luke . | |
| 4,955,844 | 9/1990 | Miller | 446/330 |

FOREIGN PATENT DOCUMENTS

| | | |
|---|---|---|
| 447612 | 3/1948 | Canada . |
| 489910 | 1/1953 | Canada . |
| 648654 | 9/1962 | Canada . |
| 978743 | 12/1975 | Canada . |

*Primary Examiner*—Mickey Yu

*Attorney, Agent, or Firm*—Fetherstonhaugh & Company

[57] ABSTRACT

A model figure connected to a remote pistol grip handle has one or more activity motions for the figure controlled from the handle. Unlike other model figures which have activity motions, there is a pivot arrangement between the handle and the figure that allows the operator to easily move the figure on a surface. The model figure has a middle torso portion with a pin extending therethrough, a model limb for the figure is mounted to pivot on the pin, a rotating pulley is mounted on the pin to pivot the limb, and the remote pistol grip handle is connected to the figure through a wand. There is a linkage system from a trigger mechanism on the handle to the rotating pulley so that movement of the trigger mechanism pivots the limb on the pin.

9 Claims, 2 Drawing Sheets

MOVABLE FIGURE

TECHNICAL FIELD

The present invention relates to a toy and more specifically to a model figure connected to a remote pistol grip handle that has at least one activity motion that can be controlled from the handle.

BACKGROUND ART

Model figures in the shape of a sports person have been made for many years. In some cases, a model figure has a mechanism so that an arm or a leg may move in association with a racquet, stick or club. Examples of such sports figures are hockey players, golfers, baseball players and the like. Findlay in U.S. Pat. No. 1,539,251 shows a device for playing table football wherein the player has a handle rigidly attached thereto and the handle has a mechanism which when activated allows the player to move a leg to provide a kicking action. Munro in U.S. Pat. Nos. 2,513,198 and 2,616,700 shows a golf puppet ball projector wherein a golf figure has a handle rigidly attached and by activating a knob on the handle, the figure provides a golf swing. Gorman in U.S. Pat. Nos. 1,657,388 and 1,926,980 also provides a golf figure which not only has a golf swing action, but also may be pivoted about a base.

These figures provide at least one activity motion which may be operated remotely by a person holding a handle and, in the case of Gorman (U.S. Pat. No. 1,926,980), a pistol grip handle is disclosed. However, all these existing remote control mechanisms have a substantially fixed connection between the handle and the figure, thus a person operating the mechanism has to ensure that the handle from the figure is held at the correct angle, otherwise the activity motion occurs in the wrong plane.

It is an aim of the present invention to provide a model figure wherein at least one of the figure's limbs can be made to move remotely from a pistol grip handle attached via a hinged linkage mechanism to the figures. Thus an operator can adjust the angle between the pistol grip handle and the figure so that it may be operated on a floor or table and does not have a fixed angle between the handle and the figure. As well as being able to operate a limb from the pistol grip handle, in another embodiment the figure is mounted on a base and provision is made that a special thumb wheel is provided on the pistol grip handle so that movement of the wheel on the exterior of the handle rotates the figure. Thus, in the case of a golfer or hockey player, the ball or puck can be addressed from any direction by rotating the player. By utilizing a finger and thumb action, one is able to provide action for the figure in two planes.

It is a further aim of the present invention to provide a model figure with a pistol grip attached by a hinged linkage arm to the figure. The figure may be used either on its own or with others for playing a miniature sports game. Games may be designed to have several such figures for playing on either a floor, table or other surface. The pistol grip allows the model figure to be held in one hand and moved about a surface in different directions by simply moving the grip. An operator holding a pistol grip handle has controls for an activity movement such as the swing of a golf club or hockey stick, the kicking of a soccer ball and many other activities. The figure may also be rotated about its base. The figure may be moved around the floor and in some instances the base may be mounted on casters for easy movement. For example, a golfer may be moved about a simulated golf course or putting green. The golfer can swivel on a base thus allowing hitting the ball from any position and in any direction. Manipulating the controls together or separately produces a variety of actions. By pulling the trigger the activity motion occurs and by rotating a thumb wheel or thumb movement, the figure can be rotated on the base. The combined movement of thumb and forefinger provides activity for the figure in two planes. Furthermore, some of the figures may be interchangeable, for instance, a golf player may be replaced on a unitary base by a hockey figure which in turn may be replaced by a soccer player or a dancer, skater, butterfly catcher, and other different figures.

DISCLOSURE OF INVENTION

The present invention provides a model figure connected to a remote pistol grip handle having at least one activity motion comprising a model figure having a middle torso portion with a substantially horizontal pin means therein, at least one model limb for the figure, the limb mounted to pivot on the pin means, pivot means to pivot the limb on the pin means to perform the activity motion, remote pistol grip handle connected to the figure by a hinged elongated member, the pistol grip handle having a trigger mechanism, and linkage means between the trigger mechanism on the pistol grip handle and the pivot means to pivot the limb so that movement of the trigger mechanism pivots the limb on the pin means.

In a further embodiment there is provided a model figure connected to a remote pistol grip handle having at least two activity motions, comprising a model figure having a middle torso portion with a substantially horizontal pin means therein, a base beneath the figure with the figure mounted for rotation thereon, at least one model limb for the figure, the limb mounted to pivot on the pin means, pivot means to pivot the limb on the pin means to perform a first activity motion, remote pistol grip handle connected to the base beneath the figure by a hinged elongated member, the pistol grip handle having a trigger mechanism, first linkage means between the trigger mechanism on the pistol grip handle and the pivot means to pivot the limb so that movement of the trigger mechanism performs the first activity motion, rotational means to rotate the figure on the base to perform a second activity motion, thumb movement means on the remote pistol grip, and second linkage means between the thumb movement means and the rotational means to rotate the figure on the base, so that movement of the thumb movement means performs the second activity motion.

BRIEF DESCRIPTION OF DRAWINGS

In drawings which illustrate embodiments of the present invention.

BEST MODE FOR CARRYING OUT THE INVENTION

Figure 1:
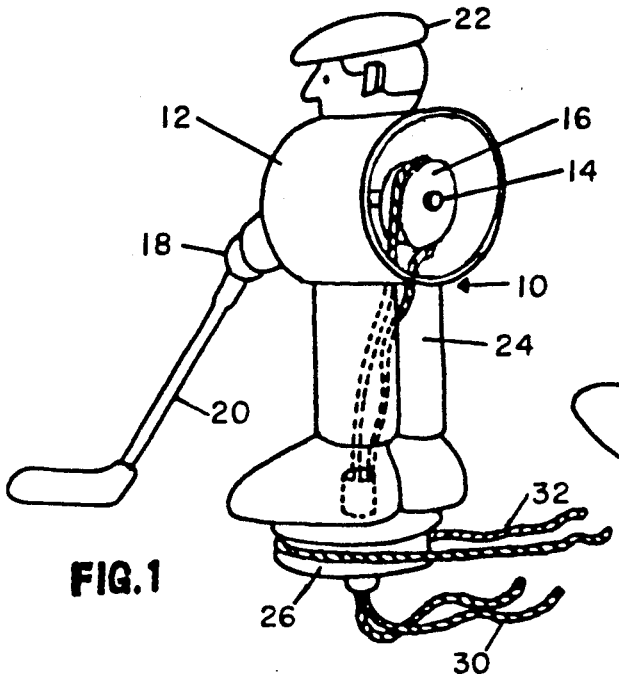
FIG. 1 is an isometric view, partly in section, showing a model golfing figure.

The model figures may be made in the form of sports players wherein each sports figure has at least one activity motion or other figures such as dancers, skaters, and any figure that has a movable limb. FIG. 1 illustrates a golfer or a hockey player 10 which has a cylindrical shaped middle torso portion 12, substantially horizontal, with a concentric pin 14 on which is mounted a first pivot pulley 16. The front of the FIG. 10 has a round disc shaped member with arms 18 holding a stick or club 20. The disc member is exactly the same diameter as the cylindrical shaped portion 12 and is connected to the pin 14 so that rotation of the first pivot pulley 16 rotates the disc, the arms 18 and the stick or club 20 about the pin 14. A removable disc (not shown) is provided for insertion into the back of the cylindrical shaped portion 12 so that the torso is enclosed.

In another embodiment, the pivot pulley 16 is removable and substantially the same size as the circular opening in the cylindrical shaped portion 12 so it fits inside the cylindrical shaped portion 12 flush with the end. This embodiment permits interchanging of figures, retaining the pivot pulley 16 for each figure.

Figure 2:
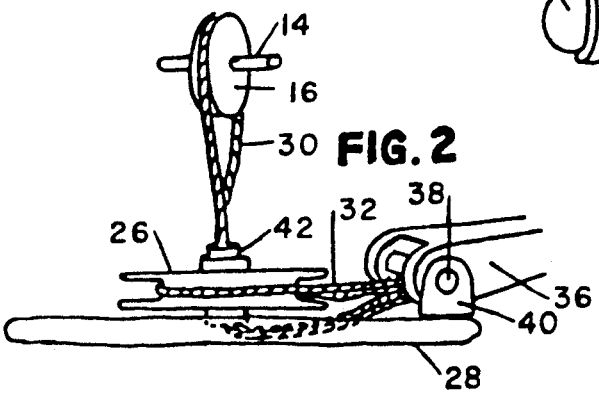
FIG. 2 is an isometric view showing one embodiment of a base for a model figure and operating mechanisms for two activity motions.

The FIG. 10 has a head 22 and legs 24 which are shown mounted on a rotational pulley 26. The rotational pulley 26 is mounted on a base 28 as shown in FIG. 2 and is able to rotate on that base 28.

The activity motion of the figure occurs by means of a first closed loop cord 30 fixed at a front or neutral position and a second closed loop cord 32. The cords pass through a longitudinal tube or wand 34 which has an end piece 36 with a hinge pin 38 to brackets 40 attached to one edge of the base 28. Thus the end piece 36 is hinge connected to the base 28. The cords 30 and 32 pass under the hinge pin 38, the first cord 30 passes into a slot in the base 28 and up through an axial hole 42 representing the rotational axis of the rotational pulley 26. The first cord 30 then passes up through one of the legs as shown in FIG. 1 and around the first pivot pulley 16. Thus, when the first cord 30 is moved, the first pivot pulley 16 rotates and the arms 18 and the stick or club 20 pivot about pin 14.

The second closed loop cord 32 passes around the rotational pulley 26 thus when the second cord 32 is moved, the FIG. 10 mounted on the rotational pulley 26 rotates.

Figure 3:
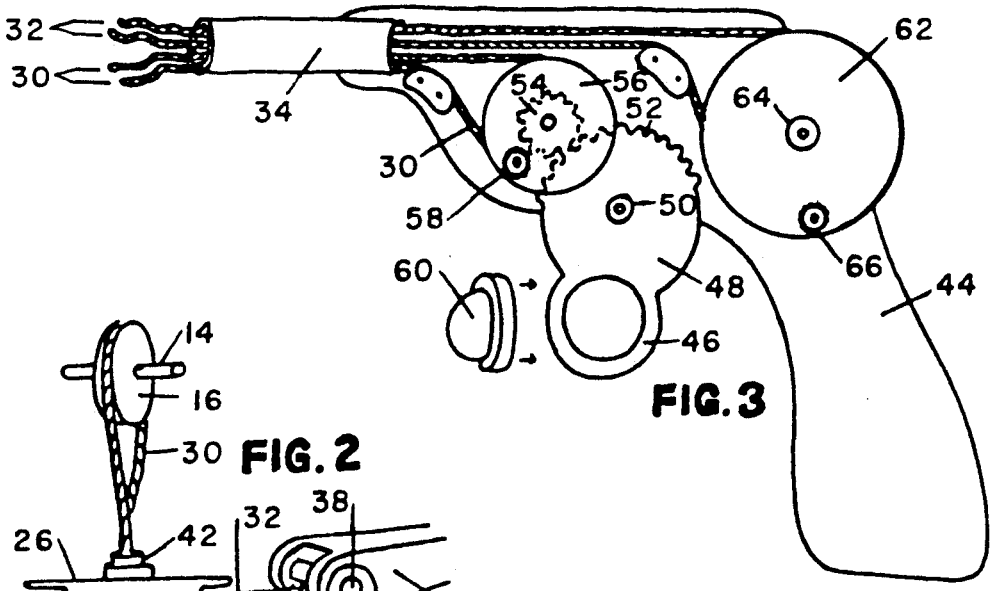
FIG. 3 is a side view, partly in section and partly exploded, showing a pistol grip handle connected to an elongated member according to one embodiment of the present invention.

A pistol grip handle 44 shown in FIG. 3 has an elongated member 34 or wand connected where the barrel of a pistol would normally be. Instead of a trigger, there is a trigger ring 46 which is sufficiently large for a person to put their first finger through. As can be seen, the trigger ring 46 is integral with a portion of a gear wheel 48 pivoted about pin 50. Teeth 52 on gear wheel 48 engage with the teeth of a sprocket 54 concentric with a second pivot pulley 56 around which the first cord 30 passes. A cord tightening pin 58 is provided to ensure that the first cord 30 is sufficiently tight so that when the trigger ring 46 is moved backwards and forwards, the first cord 30 is moved by the second pivot pulley 56 and the first cord 30 passing through the elongated member tube 34 and up to the first pivot pulley 16 provides motion to the arms 18 and stick or club 20 of the FIG. 10.

The cord tightening pin 58 has a knurled knob on the exterior of the second pivot pulley 56, the first cord 30 is wrapped around the pin 58, so by rotating the pin, the cord is tightened.

A removable concave plug 60 fits into the trigger ring 46. The concave plug is made from rubber or other suitable flexible material and allows a small finger to engage in the concave plug 60 and thus have exact control over positioning of the trigger ring 46. The concave plug 60 can be inserted into the trigger ring 46 from either side, thus the pistol grip handle 44 can be used by either a left handed or right handed person.

The second closed loop cord 32 rotates around a thumb wheel 62 located at the position where one would cock a pistol. The thumb wheel 62 rotates about pivot pin 64 and has a cord tightening pin 66 to ensure sufficient tension is maintained in the second cord 32. By gripping the handle 44, a person is able to place a first finger in the trigger ring 46 and a thumb on the thumb wheel 62. Movement of the first finger in the trigger ring 46 pivots the stick or club 20 about the pin 14. Movement of the thumb or the thumb wheel 62 rotates the FIG. 10 on the base 28. The base 28 can be moved around the floor by pushing and pulling the handle 44. A person is therefore able to position the figure to hit a ball or puck and activate the stick or club 20. The hit or shot may be made in either direction. One simply has to leave the first finger in the trigger ring 46 and move it forwards or backwards, depending upon the required direction of the shot. The combined movement of thumb and forefinger provides activity for the figure in two planes.

Figure 4:
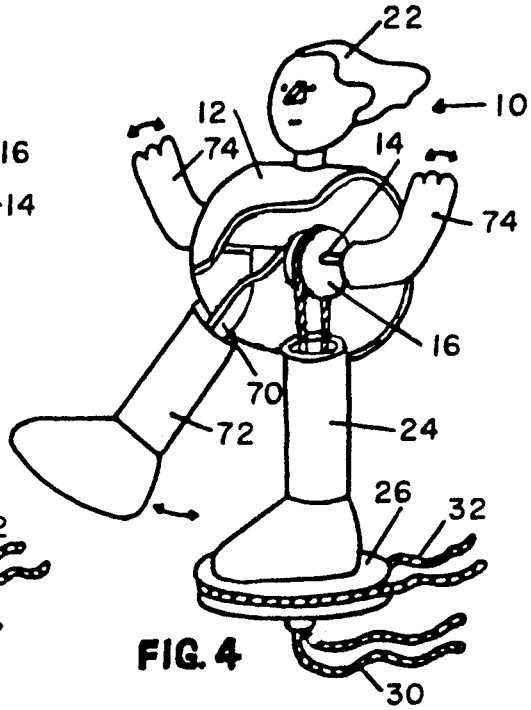
FIG. 4 is an isometric view, partly in section, showing a model soccer player figure.

Another example of a model figure is illustrated in FIG. 4 wherein the cylindrical shaped middle torso portion 12 is arranged to have the pivot pin 14, which is substantially horizontal, across the body rather than back to front as in FIG. 1. The concentric pin 14 has a limb strip 70 attached thereto which in turn is connected to a leg 72. The limb strip 70 passes through a slot (not shown) in the surface of the cylindrical portion 12 and also has arms 74 attached to ends of the pin 14. A stationary leg 24 is shown mounted on the rotational pulley 26 thus the model FIG. 10 rotates about the stationary leg 24. The activity motion occurs when the first cord 30 moves and the leg 72 pivots on the pin to provide a kicking action.

Figure 5:
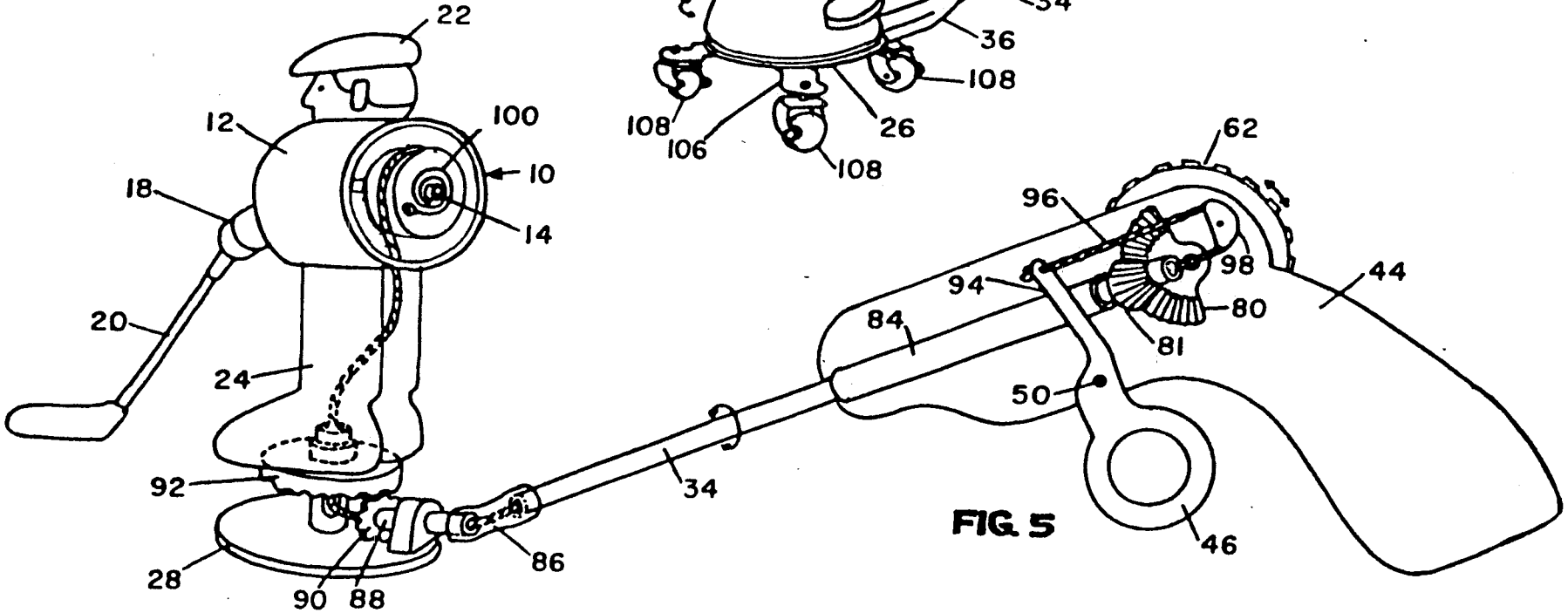
FIG. 5 is an isometric view showing a model figure mounted for rotation on a base and illustrating other mechanisms for providing two activity motions from a pistol grip handle.

Another embodiment of the model figure is illustrated in FIG. 5 wherein the operating mechanism is somewhat different. The activity motions occur by using the first finger and thumb of a hand holding the pistol grip handle 44. The thumb wheel 62 is joined to a sector gear 80 which in turn rotates a pinion 82 connected to the tube 34. A sleeve 84 supports the tube 34 and allows it to be rotated therein. The sleeve is attached to the body of the pistol grip handle 44. The tube 34 is preferably resilient and at its far end has a flexible rubber or plastic connection 86 to a drive pinion shaft 88 connected to drive pinion 90. The drive pinion 90 rotates a planetary gear 92 which acts in the same way as the rotating pulley 26 shown in FIG. 2. The gear ratios are such so that preferably the thumb wheel 60 is rotated about 90° for the complete movement, and this rotates the figure about 270°. The FIG. 10 is mounted on top of the planetary gear 92. Thus, rotation of the thumb wheel 62 causes the FIG. 10 to rotate.

The activity motion occurs by moving the trigger ring 46 backwards and forwards in the same manner as shown in FIG. 3. The trigger ring 46 is pivoted at pivot point 50 and has an arm 94 connected to a single cord 96. The cord 96 passes around a guide 98 and through the centre of the pinion 82 and the elongated tube 34 to exit from the centre of the drive pinion 90. The cord 96 passes up through the axial centre of the planetary gear 92 and is connected to a spring return pulley 100 on the pivot pin 14. The spring return arrangement is between the pulley 100 and the FIG. 10, to ensure that the pulley returns to its original position when the string is released. When the trigger ring 46 is pulled towards the butt of the pistol grip 44 the activity motion of the figure occurs, for example the golfer swings his club or the soccer player kicks his leg, and when the trigger ring 46 is released the spring return in pulley 100 returns the golf club 20 or leg 72 to the original position. The spring return motion may provide the activity motion, or may return to the original position.

Figure 6:
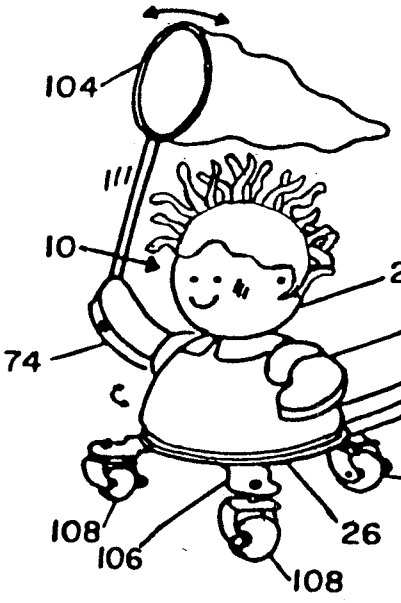
FIG. 6 is an isometric view showing a model butterfly catcher figure.

In another embodiment as shown in FIG. 6, the model figure represents a butterfly catcher with a butterfly net 104 connected to arm 74. The arms are both joined to pivot pin 14 in a manner similar to that shown in FIG. 4. The arms 74 pivot up and down by operation of the first cord 30. The rotational pulley 26 is connected to the second cord 32. A base frame 106 has extensions supporting the rotational pulley 26 and also connected to the end piece 36 of the elongated member 34. Castors 108 are shown on the base frame 106 to permit easy movement of the FIG. 10 on the floor.

The natural movement of rubbing thumb and forefinger together is exploited in the movement of these model figures. This natural movement is transferred into action for the figure in two planes. Some of the figures may be made interchangeable by having different mounts onto the rotating pulley 26. The first pivot pulley 16 and first cord 30 can be removed from the figures and repositioned into another figure. If the cords become loose, provision is made for tightening them to ensure they do not slip on the pulleys and the flexibility provided by the hinged elongated member at the base of the model figures provides the ability to change the angle for holding each figure and keeping it on the floor while holding the pistol grip handle 44.

A number of different figures may be provided, a golfer or hockey player similar to that shown in FIG. 1, a soccer player similar to that shown in FIG. 4. A butterfly catcher as shown in FIG. 6 is another alternative figure. A Russian dancer may also be provided, the leg flying out due to centrifugal force when the dancer is rotated. This figure has only rotational movement provided by the trigger ring 46. A ratchet mechanism (not shown) in the base of the figurine permits the figure to be spun continuously by repeatedly moving the trigger ring 46. Similarly a skater may be provided with arms that rise and fall due to centrifugal force. The skater can be spun by repeatedly moving the trigger ring 46.

The figures may be used in association with a game, for instance, a golf game may be provided with a miniature course and two players, each with a model figure can play on the course with appropriate balls. Hockey may also be played. In one game, each player has two figures, a forward and a goalie, one figure in each hand, and a miniature rink is provided for playing the game.

The hockey player shown in FIG. 1 may be changed to another embodiment wherein the torso is positioned similar to the soccer player figure shown in FIG. 4. The pivot pin 14 extends across the face of the body. The players arms are in the form of a U connected to the ends of the pivot pin 14 outside the cylindrical torso 12. The arms join together in front of the player and have a hockey stick extending therefrom. Thus, the elevation of the hockey stick is positioned by the limb activity motion but the actual hitting action occurs by rotating the player. The figure is suitable for a hockey goalie.

Various changes may be made to the embodiments shown herein without departing from the scope of the present invention which is limited only by the following claims.

The embodiments of the present invention in which an exclusive property or privilege is claimed are defined as follows:

1. A model figure connected to a remote pistol grip handle having at last two activity motions, comprising:

a model figure having a middle torso portion with a substantially horizontal pin means therein;

a base beneath the figure with the figure mounted for rotation thereon;

at least one model limb for the figure, the limb mounted to pivot on the pin means;

pivot means to pivot the limb on the pin means to perform a first activity motion;

remote pistol grip handle connected to the base beneath the figure by a hinged elongated member, the pistol grip handle having a trigger mechanism;

first linkage means between the trigger mechanism on the pistol grip handle and the pivot means to pivot the limb so that movement of the trigger mechanism performs the first activity motion;

rotational means to rotate the figure on the base to perform a second activity motion;

thumb movement means on the remote pistol grip, and second linkage means between the thumb movement means and the rotational means to rotate the figure on the base, so that movement of the thumb movement means performs the second activity motion.

2. The model figure according to claim 1 having a cylindrical shaped middle portion with a substantially horizontal axis and wherein the horizontal pin means is located at the horizontal axis.

3. The model figure according to claim 1 including a first pivot pulley on the pin means, the first linkage means including a first closed cord loop passing through a tube forming the elongated member, the first cord loop passing around the first pivot pulley and around a second pivot pulley in the remote grip handle, the second pivot pulley being rotated by moving the trigger mechanism to perform the first activity motion, and including a first rotational pulley attached to the figure, the second linkage means including a second closed cord loop passing through the tube, the second cord loop passing around the first rotational pulley, and around a second rotational pulley in the remote pistol grip handle, the second rotational pulley positioned to be rotated by thumb movement to perform the second activity motion.

4. The model figure according to claim 1 wherein the thumb movement means on the remote pistol grip is a thumb slide means to perform the second activity motion.

5. The model figure according to claim 3 wherein the figure is removable from the base to be replaced by another figure, and the first pivot pulley is removable from the middle portion for replacement in another figure.

6. The model figure according to claim 1 wherein the base is on castors.

7. The model figure according to claim 1 wherein the pivot means includes a spring loaded pulley on the pin means, the first linkage means including a single cord in a tube forming the elongated member, the cord connected to the spring loaded pulley and the trigger mechanism in the pistol grip handle, the spring loaded pulley being rotated by pulling the trigger mechanism to perform the first activity motion, and upon releasing the trigger mechanism, the limb returns to an initial position, and wherein the tube is rotatable by means of a thumb wheel on the remote pistol grip handle, the tube having means on the base to rotate the figure to perform the second activity motion.

8. The model figure according to claim 3 wherein the first rotational pulley rotates about a substantially vertical axis, and including an aperture in the first rotational pulley at the vertical axis, and wherein the first closed loop cord extends down from the first pivot pulley, through the aperture in the first rotational pulley, to pass through the tube forming the elongated member.

9. A model figure connected to a remote pistol grip handle having at least one activity motion comprising:

a model figure having a middle torso portion with a substantially horizontal pin means therein;

at least one model limb for the figure, the limb mounted to pivot on the pin means;

pivot means to pivot the limb on the pin means to perform the activity motion;

remote pistol grip handle connected to the figure by a hinged elongated member, the pistol grip handle having a trigger mechanism comprising a ginger ring with a removable concave plug for insertion on either side of the finger ring for left hand and right hand operation, and linkage means between the trigger mechanism on the pistol grip handle and the pivot means to pivot the limb so that movement of the trigger mechanism pivots the limb on the pin means.

* * * * *